US005861236A

United States Patent [19]

Verlinden et al.

[11] Patent Number: 5,861,236

[45] Date of Patent: Jan. 19, 1999

[54] METHOD FOR PROCESSING PHOTOGRAPHIC SHEET MATERIAL

[75] Inventors: Bartholomeus Verlinden, Tongeren; Patrick Van Den Bergen, Hove, both of Belgium

[73] Assignee: Agfa-Gevaert, Mortsel, Belgium

[21] Appl. No.: 969,027

[22] Filed: Nov. 12, 1997

[30] Foreign Application Priority Data

Nov. 14, 1996 [EP] European Pat. Off. ..... 96203184

[51] Int. Cl.[6] ..... G03C 5/29; G03D 3/08

[52] U.S. Cl. ..... 430/434; 430/399; 396/626; 396/636

[58] Field of Search ..... 430/399, 434, 430/464; 396/573, 577, 595, 598, 626, 636, 641

[56] References Cited

U.S. PATENT DOCUMENTS

| | | | |
|---|---|---|---|
| 5,040,013 | 8/1991 | Kurokawa et al. | 396/626 |
| 5,234,802 | 8/1993 | Nakamura et al. | 396/626 |
| 5,302,996 | 4/1994 | Hall et al. | 396/636 |
| 5,380,627 | 1/1995 | Grimsey | 430/399 |
| 5,387,499 | 2/1995 | Earle et al. | 396/626 |
| 5,452,044 | 9/1995 | Devaney, Jr. | 396/636 |
| 5,510,870 | 4/1996 | Kashino et al. | 396/626 |
| 5,652,939 | 7/1997 | Verlinden et al. | 396/636 |
| 5,689,750 | 11/1997 | Verlinden et al. | 396/636 |
| 5,737,662 | 4/1998 | Verlinden et al. | 396/636 |

*Primary Examiner*—Hoa Van Le
*Attorney, Agent, or Firm*—Baker & Botts, L.L.P.

[57] ABSTRACT

A method of processing photographic sheet material comprises passing the sheet material along a sheet material path (20) through a processing apparatus comprising a plurality of processing cells (12, 12', 12"), and causing processing liquid to pass across the surface of the sheet in at least one of the cells. The cell is a closed cell the speed of liquid flow across the sheet material, as measured in a direction perpendicular to the direction of the sheet material path (20), is at least 3 times the speed of the sheet material along the sheet material path (20) and the resultant liquid flow speed is at least 100 mm/sec. The consistency of reaction kinetics at the sheet material surface are improved.

9 Claims, 4 Drawing Sheets

METHOD FOR PROCESSING PHOTOGRAPHIC SHEET MATERIAL

DESCRIPTION

1. Field of the Invention

The present invention relates to a method of processing photographic sheet material, such as X-ray film, pre-sensitised plates, graphic art film and paper, and offset plates, particularly such a method in which the sheet material is passed along a sheet material path through a processing apparatus comprising a plurality of closed processing cells, where the sheet material comes into contact with one or more processing liquids.

2. Background of Invention

As a rule, a processing apparatus for photographic sheet material comprises several cells each of which contains a treatment liquid, such as a developer, a fixer and a rinse liquid. As used herein, the term sheet material includes not only photographic material in the form of cut sheets, but also in the form of a web unwound from a roll. The sheet material to be processed is transported through these cells in turn, by transport means such as one or more pairs of drive rollers, and thereafter optionally to a drying unit. The time spent by the sheet material in each cell is determined by the transport speed and the dimensions of the cell in the sheet feed path direction.

It is important that the kinetics of reactions occurring at the surface of the sheet material are substantially consistent, otherwise poor processing can result. Waste products from these reactions should be withdrawn from the vicinity of the surface before they can exert a negative influence. Fresh active chemicals should constantly be brought into the vicinity of the surface in a homogeneous manner in order to avoid significant slowing down of the reaction. For these reasons, it is not usual to pass the sheet material through a static liquid bath, but rather to arrange that processing liquid is caused to pass across the surface. While it might be supposed that high liquid flow rates across the surface are desirable, this may lead to such disturbance in the liquid flow that liquid levels in the processing cells become unpredictable, liquids may be caused to overflow from one cell to the next in an undesirable manner and liquid surfaces become churned up to a degree which increases evaporation and deterioration of oxygen-sensitive liquids. This is especially the case with developing liquids and also with fixing liquids.

European patent application EP 0 647 881 (Konica Corporation) discloses a processing apparatus in which the synthetic flow speed of the treatment liquid on the surface of the material is not less than 80 mm/sec. We have found that such high flow speeds in an open apparatus tend to generate turbulence and disturbance of the liquid level in the bath, resulting in non-uniform treatment. Furthermore, we have found that the optimum flow speed is related to the speed of the sheet material along the sheet material path.

OBJECTS OF INVENTION

It is an object of the present invention to improve the consistency of reaction kinetics at the sheet material surface while reducing or eliminating the aforesaid disadvantages.

SUMMARY OF THE INVENTION

We have now discovered that these and other useful objectives may achieved if the processing cells are closed and if the minimum speed of liquid flow across the sheet material, is not only above a specified minimum, but is also related to the speed of the sheet material along the sheet material path.

According to the invention there is provided a method of processing photographic sheet material comprising passing the sheet material along a sheet material path through a processing apparatus comprising a plurality of processing cells, and causing processing liquid to pass across the surface of the sheet in at least one of the cells, characterised in that the cell is a closed cell and in that the speed of liquid flow across the sheet material, as measured in a direction perpendicular to the direction of the sheet material path, is at least 3 times the speed of the sheet material along the sheet material path, such as from 3 times to 5 times the speed of the sheet material along the sheet material path, and the resultant liquid flow speed is at least 100 mm/sec.

The linear speed of the sheet material through the apparatus may typically be from 4 to 42 mm/sec. The resultant speed of liquid flow across the sheet material, being a combination of this linear sheet material speed and the speed of liquid flow across the sheet material, as measured in a direction at right angles to the direction of the sheet material path and in the plane of the sheet material, is at least 100 mm/sec, but is preferably not more than 200 mm/sec.

The processing liquid may be selected from photographic sheet material developing liquids, fixing liquids, bleach-fixing liquids, rinsing liquids and other treatment liquids. The invention is particularly beneficial however where the liquid is a developing or fixing liquid, because the homogeneous nature of the development and fixing processes respectively is particularly critical to the quality of the end result.

By the use of closed cells, that is where the cells are not open to the environment and there is no significant exchange of liquids or gases between one cell and another, liquid levels in the processing cells become more predictable, no liquids overflow from one cell to the next in an undesirable manner and liquid surfaces do not become churned up to a degree which increase evaporation and deterioration of oxygen sensitive liquids. The variation in liquid flow speed across the sheet material is reduced in a closed cell configuration. The use of a closed cell also ensures the same kinetics on both sides of the sheet material. Closed cells may be totally filled with processing liquid, so that there is no liquid level as such in the cell, or the space above the liquid may be filled with inert gases. In any event, even when such a space is filled with air, exchange between the liquid and the air quickly reaches an equilibrium where evaporation and oxidation are much reduced.

For X-ray applications, processing conditions and the composition of processing solutions are dependent on the specific type of photographic material. For example, materials for X-ray diagnostic purposes may be adapted to rapid processing conditions. Preferably the processing apparatus is provided with a system for automatic regeneration of the processing solutions. The material may be processed using one-part package chemistry or three-part package chemistry, depending on the processing application determining the degree of hardening required in the processing cycle. Applications within total processing times of 30 seconds and higher up to 90 seconds, known as common practice, are possible. The processing may take place in a glutaraldehyde containing hydroquinone/1-phenyl-3-pyrazolidinone developer marketed by Agfa-Gevaert NV under the Trade Name G138 having a high activity or in a cheap developer with a low activity having the following composition amounts given in g/l.

| | |
|---|---|
| hydroquinone | 13.3 |
| phenidone | 0.8 |
| sodium metabisulphite | 29.7 |
| ethylenediamine tetraacetic acid, tetrasodium salt trihydrate | 1.33 |
| potassium hydroxide | 27.9 |
| sodium tetraborate decahydrate | 8.8 |
| acetic acid | 5.2 |
| 5-methylbenzotriazole | 0.04 |
| 5-nitrobenzimidazole | 0.05 |
| glutaraldehyde | 3.0 |
| diethylene glycol | 12.8 |

Another suitable developer composition for X-ray sheets is the following:

| | |
|---|---|
| Composition A | |
| potassium hydroxide composition (0.76 g/ml) | 74 ml |
| demineralised water | 100 ml |
| potassium sulphite solution (0.655 g/ml) | 390 ml |
| Trilon B (0.524 g/l) | 16 ml |
| Turpinol 2 NZ | 4 g |
| diethyleneglycol | 100 ml |
| potassium chloride | 3.2 g |
| potassium carbonate solution (0.765 g/ml) | 168 ml |
| hydroquinone | 120 g |
| Cobratec TT 100 | 0.36 g |
| demineralised water to | 1000 ml |
| Composition B | |
| acetic acid 99% | 38 ml |
| phenidone | 6 g |
| 5 nitro-indazol | 1 g |
| polyethylene glycol 350 | 1 ml |
| diethylene glycol to | 100 ml |
| Composition C | |
| glutaraldehyde | 76 ml |
| potassium metabisulphite | 36 g |
| demineralised water to | 100 ml |

Before use, 1 l of composition A is mixed with 2.8 l water, 100 ml composition B and 100 ml composition C.

Another suitable developer solution for X-ray sheets is the following:

| | |
|---|---|
| Composition A | |
| ammonium thiosulphate solution (0.778 g/ml) | 880 ml |
| sodium sulphite (anhydrous) | 54 g |
| boric acid (sieved) | 25 g |
| sodium acetate 3 aq. | 70 g |
| acetic acid 96% | 40 ml |
| demineralised water to | 1000 ml |
| Composition B | |
| demineralised water | 110 ml |
| acetic acid 96% | 40 ml |
| aluminium sulphate solution (0.340 g/l) | 100 ml |

Before use, 3.750 l water is mixed with 1 l composition A and 0.25 l composition B.

Within the scope of the processing method of this invention, said method may be applied to any diagnostic film exposed with a laser directed by digitised data obtained after conversion of information captured by suitable means after exposure to radiation of part of the human body or exposed after conversion of X-rays by one or two intensifying light emitting screen(s), wherein said film may comprise cubic and/or {111} or {100} tabular silver halide crystals rich in silver chloride, provided that with minimum amounts of silver coated a sufficient covering power is attained in the film after rapid ecological processing (with e.g. ascorbic acid and/or derivatives thereof as developing agent(s)) in a (preferentially) hardener-free developer and an odour-free fixer, optionally free of aluminium ions, thereby reducing sludge, with replenishing amounts for developer and fixer as low as possible and further provided that an optimised relationship is attained between sensitometry and image quality, especially sharpness, partly thanks to low cross-over exposure in the case of double-side coated films.

Photographic sheet materials designed for one sheet silver complex diffusion transfer reversal process (DTR process) may be developed with the aid of an aqueous alkaline solution in the presence of (a) developing agent(s) and (a) silver halide solvent(s).

Preferably the silver halide solvent is used in an amount between 0.01% by weight and 10% by weight and more preferably between 0.05% by weight and 8% by weight. Suitable silver halide solvents for use in connection with the present invention are e.g. 2-mercaptobenzoic acid, cyclic imides, oxazolidones and thiosulphates. Silver halide solvents that are preferably used are thiocyanates and alkanolamines.

Alkanolamines that are suitable for use in DTR processing may be of the tertiary, secondary or primary type. Examples of alkanolamines that may be used correspond to the following formula:

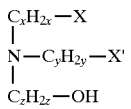

wherein X and X' independently represent hydrogen, a hydroxyl group or an amino group, x and y represent 0 or integers of 1 or more and z represents an integer of 1 or more. Preferably used alkanolamines are e.g. N-(2-aminoethyl)ethanolamine, diethanolamine, N-methylethanolamine, triethanolamine, N-ethyldiethanolamine, diisopropanolamine, ethanolamine, 4-aminobutanol, N,N-dimethylethanolamine, 3-aminopropanol, N,N-ethyl-2,2'-iminodiethanol, 2-aminoethyl-aminoethanol etc. or mixtures thereof.

The alkanolamines are preferably present in the alkaline processing liquid. However part or all of the alkanolamine can be present in one or more layers of the imaging element.

A further suitable type of silver halide solvents are thioether compounds. Preferably used thioethers correspond to the following general formula:

$$Z—(R^1—S)_t—R^2—S—R^3—Y$$

wherein Z and Y each independently represents hydrogen, an alkyl group, an amino group, an ammonium group, a hydroxyl, a sulpho group, a carboxyl, an aminocarbonyl or an aminosulphonyl, $R^1$, $R^2$ and $R^3$ each independently represents an alkylene that may be substituted and optionally contain an oxygen bridge and t represents an integer from 0 to 10. Examples of thioether compounds corresponding to the above formula are disclosed in e.g. United States patent U.S. Pat. No. 4,960,683 and European patent application EP-A-547662, which therefor are incorporated herein by reference.

Still further suitable silver halide solvents are meso-ionic compounds. Preferred meso-ionic compounds for use in connection with DTR processing are triazolium thiolates and more preferred 1,2,4-triazolium-3-thiolates.

At least part and most preferably all of the meso-ionic compound is present in the alkaline processing liquid used for developing the image-wise exposed imaging element. Preferably the amount of meso-ionic compound in the alkaline processing liquid is between 0.1 mmol/l and 25 mmol/l and more preferably between 0.5 mmol/l and 15 mmol/l and most preferably between 1 mmol/l and 8 mmol/l.

However the meso-ionic compound may be incorporated in one or more layers comprised on the support of the imaging element. The meso-ionic compound is in that case preferably contained in the imaging element in a total amount between 0.1 and 10 mmol/$m^2$, more preferably between 0.1 and 5 mmol/$m^2$ and most preferably between 0.5 and 1.5 mmol/$m^2$. More details are disclosed in European patent application EP-A-554585.

The alkaline processing liquid used preferably has a pH between 9 and 14 and more preferably between 10 and 13. The pH may be established by an organic or inorganic alkaline substance or a combination thereof. Suitable inorganic alkaline substances are e.g. potassium or sodium hydroxide, carbonate, phosphate etc. Suitable organic alkaline substances are e.g. alkanolamines. In the latter case the alkanolamines will provide or help maintain the pH and serve as a silver halide complexing agent.

The alkaline processing liquid may also contain (a) developing agent(s). In this case the alkaline processing liquid is called a developer. On the other hand some or all of the developing agent(s) may be present in one or more layers of the photographic material or imaging element. When all of the developing agents are contained in the imaging element the alkaline processing liquid is called an activator or activating liquid.

Silver halide developing agents for use in accordance with the present invention are preferably of the p-dihydroxybenzene type, e.g. hydroquinone, methylhydroquinone or chlorohydroquinone, preferably in combination with an auxiliary developing agent being a 1-phenyl-3-pyrazolidone-type developing agent and/or p-monomethylaminophenol. Particularly useful auxiliary developing agents are the 1-phenyl-3-pyrazolidones. Even more preferred, particularly when they are incorporated into the photographic material are 1-phenyl-3-pyrazolidones of which the aqueous solubility is increased by a hydrophilic substituent such as e.g. hydroxy, amino, carboxylic acid group, sulphonic acid group etc. Examples of 1-phenyl-3-pyrazolidones substituted with one or more hydrophilic groups are e.g. 1-phenyl-4,4-dimethyl-2-hydroxy-3-pyrazolidone, 1-(4-carboxyphenyl)-4,4-dimethyl-3-pyrazolidone etc. However other developing agents can be used.

At least the auxiliary developing agents are preferably incorporated into the photographic material, preferably in the silver halide emulsion layer of the photographic material, in an amount of less than 150 mg/g of silver halide expressed as $AgNO_3$, more preferably in an amount of less than 100 mg/g of silver halide expressed as $AgNO_3$.

The alkaline processing liquid used for developing a DTR imaging element preferably also contains hydrophobizing agents for improving the hydrophobicity of the silver image obtained in the image receiving layer. The hydrophobizing agents used in connection with DTR processing are compounds that are capable of reacting with silver or silver ions and that are hydrophobic i.e. insoluble in water or only slightly soluble in water. Generally these compounds contain a mercapto group or thiolate group and one or more hydrophobic substituents e.g. an alkyl group containing at least 3 carbon atoms. Examples of hydrophobizing agents for use in DTR processing are e.g. those described in United States patents U.S. Pat. No. 3,776,728, and U.S. Pat. No. 4,563,410. Preferred compounds correspond to one of the following formulae:

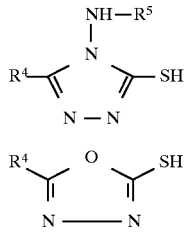

wherein $R^5$ represents hydrogen or an acyl group, $R^4$ represents alkyl, aryl or aralkyl. Most preferably used compounds are compounds according to one of the above formulas wherein $R^4$ represents an alkyl containing 3 to 16 C-atoms.

The hydrophobizing agents are contained in the alkaline processing liquid in an amount of at least 0.1 g/l, more preferably at least 0.2 g/l and most preferably at least 0.3 g/l. The maximum amount of hydrophobizing agents will be determined by the type of hydrophobizing agent, type and amount of silver halide solvents etc. Typically the concentration of hydrophobizing agent is preferably not more than 1.5 g/l and more preferably not more than 1 g/l.

The alkaline processing liquid preferably also contains a preserving agent having antioxidation activity, e.g. sulphite ions provided e.g. by sodium or potassium sulphite. For example, the aqueous alkaline solution comprises sodium sulphite in an amount ranging from 0.15 to 1.0 mol/l. Further may be present a thickening agent, e.g. hydroxyethylcellulose and carboxymethylcellulose, fog inhibiting agents, e.g. potassium bromide, potassium iodide and a benzotriazole which is known to improve the printing endurance, calcium-sequestering compounds, anti-sludge agents, and hardeners including latent hardeners. It is furthermore preferred to use a spreading agent or surfactant in the alkaline processing liquid to assure equal spreading of the alkaline processing liquid over the surface of the photographic material. Such a surfactant should be stable at the pH of the alkaline processing liquid and should assure a fast overall wetting of the surface of the photographic material. A surfactant suitable for such purpose is e.g. a fluorine containing surfactant such as e.g. $C_7F_{15}COONH_4$. It is furthermore advantageous to add glycerine to the alkaline processing liquid so as to prevent crystallization of dissolved components of the alkaline processing liquid.

Development acceleration can be accomplished by addition of various compounds to the alkaline processing liquid and/or one or more layers of the photographic element, preferably polyalkylene derivatives having a molecular weight of at least 400 such as those described in e. g. United States patents U.S. Pat. No. 3,038,805, U.S. Pat. No. 4,038,075, U.S. Pat. No. 4,292,400 and U.S. Pat. No. 4,975,354.

Subsequent to the development in an alkaline processing liquid, the surface of the printing plate is preferably neutralized using a neutralization liquid.

A neutralization liquid generally has a pH between 5 and 8. The neutralization liquid preferably contains a buffer e.g. a phosphate buffer, a citrate buffer or mixture thereof. The neutralization solution can further contain bactericides, substances which influence the hydrophobic/hydrophilic balance of the printing plate obtained after processing of the DTR element, e.g. hydrophobizing agents as described above, silica and wetting agents, preferably compounds containing perfluorinated alkyl groups.

The two-sheet DTR process is by nature a wet process including development of the exposed silver halide in the emulsion layer of the photosensitive element, the complexing of residual undeveloped silver halide and the diffusion transfer of the silver complexes into the image-receiving material wherein physical development takes place.

The processing proceeds in alkaline aqueous medium.

The developing agent or a mixture of developing agents can be incorporated into the alkaline processing solution and/or into the imaging material. When incorporated into the photosensitive element, the developing agent(s) can be present in the silver halide emulsion layer or is (are) preferably present in a hydrophilic colloid layer in water-permeable relationship therewith, e.g. in the anti-halation layer adjacent to the silver halide emulsion layer of the photosensitive element. In case the developing agent or a mixture of developing agents is in its total contained in the photosensitive element, the processing solution is merely an aqueous alkaline solution that initiates and activates the development.

Suitable developing agents for the exposed silver halide are e.g. hydroquinone-type and 1-phenyl-3-pyrazolidone-type developing agents as well as p-monomethylaminophenol. Preferably used is a combination of a hydroquinone-type and 1-phenyl-3-pyrazolidone-type developing agent whereby the latter is preferably incorporated in one of the layers comprised on the support of the imaging material. A preferred class of 1-phenyl-3-pyrazolidone-type developing agents is disclosed in European patent application EP-A-498968.

The silver halide solvent, preferably sodium or ammonium thiosulphate, may be supplied from the non-light-sensitive image-receiving element as mentioned above, but it is normally at least partly already present in the alkaline processing solution. When present in the alkaline processing solution, the amount of silver halide solvent is in the range of e.g. 10 g/l to 50 g/l.

Preferred alkaline substances are inorganic alkali e.g. sodium hydroxide, sodium or potassium carbonate, sodium phosphate, sodium borate or alkanolamines or mixtures thereof. Preferably used alkanolamines are tertiary alkanolamines e.g. those described in European patent applications EP-A 397925, 397926, 397927 and 398435 and United States patent U.S. Pat. No. 4,632,896. A combination of alkanolamines having both a $pK_a$ above or below 9 or a combination of alkanolamines whereof at least one has a $pK_a$ above 9 and another having a $pK_a$ of 9 or less may also be used as disclosed in the Japanese patent applications laid open to the public numbers 73949/61, 73953/61, 169841/61, 212670/60, 73950/61, 73952/61, 102644/61, 226647/63, 229453/63, United States patent U.S. Pat. Nos. 4,362,811 and 4,568,634. The concentration of these alkanolamines is preferably from 0.1 mol/l to 0.9 mol/l.

The alkaline processing solution usually contains preserving agents e.g. sodium sulphite, thickening agents e.g. hydroxyethylcellulose and carboxymethylcellulose, fog-inhibiting agents such as potassium bromide, black-toning agents especially heterocyclic mercapto compounds, detergents e.g. acetylenic detergents such as SURFYNOL 104, SURFYNOL 465, SURFYNOL 440 etc. all available from Air Reduction Chemical Company, New York, USA.

The DTR-process is normally carried out at a temperature in the range of 10° C. to 35° C.

The pH of the processing solution is preferably in the range of 9 to 14, more preferably in the range of 10 to 13.

Photolithographic plates may be processed by compositions with an aqueous alkaline developer comprising at least one basic substance such as potassium hydroxide or sodium silicate, and one neutral salt such as sodium or potassium chloride. Examples of such developers include:

| Composition A | |
|---|---|
| sodium metasilicate $5H_2O$ | 30 g |
| Aerosol OS (Trade Mark) | 2.16 g |
| sodium chloride | 30 g |
| Water to | 1000 ml |
| **Composition B** | |
| sodium metasilicate $5H_2O$ | 4.0% |
| trisodium phosphate $12H_2O$ | 3.4% |
| monosodium phosphate | 0.3% |
| sodium hydroxide (reagent grade) | 0.7% |
| soft water | 1000 ml |

For the processing of graphic arts sheet materials, developers typically contain hydroquinone, together with alkali metal (sodium or potassium) carbonates, sulphites and bromides. These compositions are used at a pH level of typically from 10.5 to 13.5.

All cells of the apparatus may be closed, but it is within the scope of this invention to leave some cells open to the environment if so desired, provided that the cell containing the processing liquid is closed. One or more cells may not contain processing liquid, these cells providing, for example, a dead space where diffusion reactions can occur on the sheet material as it passes there-through.

In one embodiment, the cell is closed from the next adjacent cell by a rotatable roller biased towards a reaction surface to define a roller nip there-between through which the sheet material path extends and associated sealing means serve to provide a gas- and liquid-tight seal between the roller and reaction surface on the one hand and a cell wall on the other. The reaction surface will usually be the surface of another rotatable roller or may be in the form of a belt or a fixed surface with a low friction coefficient. Where this general description refers to the use of two rollers, it is to be understood that the second roller may be replaced by any other reaction surface, such as those referred to above. Such rollers constitute path-defining rollers and may be driven rollers or freely rotating rollers.

Typical rollers have a core provided with a covering of elastomeric material, although it is possible for the roller to be elastomeric throughout its cross-section. As the sheet material leaves a given liquid treatment cell it is necessary to remove any liquid carried on the sheet material as efficiently as possible, to prevent carryover of liquid into a next treatment cell and to reduce edge effects which arise from non-homogeneous chemistry on the sheet material after squeegeeing. To do this job properly, the rollers must exert a sufficient and homogeneous pressure over the whole width of the sheet material. Also, to reduce edge effects, it is desirable that the opposite roller surfaces are in contact with each other beyond the edges of the sheet material. To put this problem in context, rollers used in conventional processing apparatus for example have a length of 400 mm or more and a diameter of from 24 to 30 mm. The sheet material typically has a width of from a few millimeters up to 2.m and a thickness of 0.05 mm to 0.5 mm. In view of the nature of elastomeric material, it is in fact impossible to totally eliminate any gap between the roller surfaces at the edges of the sheet material as it passes through the nip. It is desirable that the roller surfaces be in contact with each other within as short a distance as possible from the edges of the sheet material i.e. that the size of the leak zone should be minimised. It is important however that the force between the rollers is sufficient to prevent leakage when no sheet material is passing through. However, the force must not be so high as to risk physical damage to the sheet material as it passes through the nip.

The objective of a minimum leak zone referred to above can be achieved if the ratio of the diameter of the roller to its length is above a critical limit.

According to a preferred embodiment therefore, at least one of the rollers, and preferably each roller, comprises a rigid core carrying a covering of elastomeric material, the ratio ($\phi$/L) of the maximum diameter ($\phi$) of the elastomeric material covering to the length (L) thereof being at least 0.012, most preferably between 0.03 and 0.06. Where the reaction surface towards which the roller is biased to define the nip is the surface of another roller, it is preferred that the roller requirements referred to above apply to this, second, roller also. Indeed, it will be usual for the two rollers to be identical, although it is possible that the diameters ($\phi$), and therefore the ratios ($\phi$/L), of the two rollers need not be identical. It is also possible that the reaction surface may be formed by the surface of a second roller which does not conform to the above requirements, such as for example, a roller having no elastomeric covering, or for the reaction surface to be in the form of a belt.

The elastomeric material covering preferably has a thickness of between 1 mm and 30 mm. The elastomeric material may be selected from ethylene/propylene/diene terpolymers (EPDM), silicone rubber, polyurethane, thermoplastic rubber such as Santoprene (Trade Mark for polypropylene/EPDM rubber), styrene-butyl rubber and nitrile-butyl rubber. The hardness of the elastomeric material may be between 15 Shore (A) and 90 Shore (A), as measured on the roller surface. In one embodiment, the diameter ($\phi$) of the elastomeric material covering is constant along the length of the roller. Alternatively the roller may have a radial dimension profile which varies along the length thereof. In the latter case, the diameter ($\phi$) in the expression $\phi$/L is the maximum diameter. In a preferred embodiment, such a roller comprises a non-deformable core, the thickness of the elastomeric material covering varying along the length thereof. Alternatively or additionally, the diameter of the core varies along the length thereof.

Ideally, the radial dimension profile of such a roller is such in relation to the force applied by the roller to sheet material passing through the nip as to be substantially even over the width thereof.

The radial dimension of the roller ideally decreases towards the ends thereof i.e. a convex profile, especially a parabolic profile.

Preferably, the core has a flexural E-modulus of between 50 GPa and 300 GPa. Suitable materials for the rigid core include metals, such as stainless steel, non-ferrous alloys, titanium, aluminium or a composite thereof.

In one embodiment, the core is hollow. Alternatively the core may be solid.

The rollers may be biased together by a variety of methods. The rollers may be biased together for example by making use of the intrinsic elasticity of the elastomeric material, by the use of fixed roller bearings. Alternatively, use may be made of resilient means such as springs which act on the ends of the roller shafts. The springs may be replaced by alternative equivalent compression means, such as e.g. a pneumatic or a hydraulic cylinder.

The sealing means between the path-defining rollers and a housing wall of the cell may be formed in a number of ways. In one arrangement, the rollers are offset relative to each other and each roller is in sealing contact along its length, at least between limits of the nip, with a stationary sealing member. In an alternative arrangement, the rollers are positioned relative to each other such that end faces of one roller lie in substantially the same plane as end faces of the other roller, and stationary sealing means are provided in contact with each roller, having a continuous contact line which extends along the length of each roller and over the end faces of each roller, at least on the fluid side of the nip.

However, our preferred arrangement is where each path-defining roller is in contact along its length with a rotatable sealing member. By the use of a rotatable sealing member in place of a stationary sealing member, the torque which needs to be applied to the path-defining roller can be significantly reduced. This reduces the power needed by the processor, reduces wear on the path-defining roller, reduces the mechanical deformation thereof and thereby extends the expected life time. This construction also improves the control of pressure distribution over the sheet material.

The rotatable sealing member preferably comprises a sealing roller, and in particular the sealing roller may have a diameter less than that of the path-defining roller. For example, the sealing roller may have a diameter which is from one tenth to one third of the diameter of the path-defining roller, thereby enabling the torque which needs to be applied to be further reduced. The sealing roller preferably extends in a straight line parallel to the associated path-defining roller axis and preferably contacts the surface of the associated path-defining roller at a location which is between 45° and 315°, most preferably between 8° and 100° from the centre of the nip, on the fluid side.

The sealing roller may be formed of a material having a coefficient of friction (as measured against stainless steel) of less than 0.3, preferably from 0.05 to 0.2, for example highly polished metals such as steel, especially Cr-Ni steel and Cr-Ni-Mo steel, a metal coated with Ni-PTFE (NIFLOR—Trade Mark), a polymer material such as PTFE (poly tetra fluoro ethylene), POM (polyoxymethylene), HDPE (high density polyethylene), UHMPE (ultra high molecular weight polyethylene), polyurethane, PA (polyamide), PBT (polybutyl terephthalate) and mixtures and composites thereof.

In a preferred embodiment, the sealing roller is carried by a longitudinal bearing, secured within the cell. The longitudinal bearing may have face-to-face contact with the sealing roller over at least two contact regions, which are located, for example, at from ±120° to 150° relative to the line joining the centres of a path-defining roller and its associated sealing roller, such as ±135° to that line. The width of contact between a sealing roller and its associated longitudinal bearing in each contact region is, for example, from 20° to 40° of the circumference of the sealing roller, which in the case of a sealing roller having a diameter of 8 mm may be about 2 mm per contact region.

The surface of the sealing roller opposite to the path-defining roller may be in contact with one or more fixed sealing members carried in, or formed as part of, the longitudinal bearing. The fixed sealing member may, for example, be retained within a longitudinal groove formed in the longitudinal bearing. The fixed sealing member may have a symmetrical profile section but a non-symmetrical profile section is also possible, its shape and resilience taking into account the hydrostatic and hydrodynamic pressures in the cell and the interacting forces with the sealing roller, allowing for the fact that the path-defining roller and the sealing roller may be adapted to rotate in both directions.

The ends of the sealing roller may be in contact in a leak-free manner with stationary bodies, such as an end plate secured to, or located in a fixed position relative to, the housing of the apparatus. For example, the end of the sealing roller passes into a blind aperture in the end plate. In an alternative embodiment, the end of the sealing roller is located in an open aperture in the end plate, this aperture being provided with a sealing ring, or other sealing member, formed for example of sintered PTFE, to prevent leakage therethrough.

It is important that the sealing rollers are retained in these end plates in a leak-free manner. A line contact between the sealing rollers and the end plates is preferred to a surface-to-surface contact. In one embodiment, the sealing ring surrounds the end of the sealing roller and is urged into line-to-surface sealing engagement with the surface of the sealing roller by a spring. We have found that line contact between the sealing roller and the end plates need not extend circumferentially completely around the sealing roller, and indeed there is an advantage in this line contact extending only part way around the sealing roller, but on the liquid side thereof. This construction makes the tolerances to which the sealing roller and the end plates are constructed less critical. It is preferred to use a sealing ring which is so constructed as to compensate for the wear thereof. This can be achieved by forming the sealing ring with a frusto-conical inner surface and by the provision of a spring force which acts in a direction to feed sealing material towards the wear surface. We prefer to use a material for the sealing ring which has good "creeping" characteristics to compensate for the wear under spring pressure, such as sintered PTFE.

In an alternative embodiment, end portions of the sealing roller are formed of an elastomeric material, such as natural or synthetic rubber, and these end portions press against the end plates in a leak-free manner.

The processing liquid is preferably fed to the cell adjacent one edge of the sheet material and is withdrawn from the cell adjacent the opposite edge thereof, thereby to provide a continuos liquid flow across the sheet material. Ideally, the continuous liquid flow extends in a direction perpendicular to the direction of the sheet material path. Where the cell includes path-defining rollers, it is beneficial for the liquid flow to extend across the sheet material path in a direction parallel to the roller axis.

The processing liquid is usually fed to the cell by a pump, which enables the speed of liquid flow across the sheet material being controlled by operation of the pump.

By the use of closed cells in the present invention, and the greater assurance of homogeneous reaction kinetics at the sheet material surface, it is now possible to successfully process the sheet material when the temperature of the processing liquid in the cell is from 15° C. to 45° C., such as from 30° C. to 35° C., or even from 35° C. to 40° C., even as high as 55° C.

In one embodiment of the apparatus, the plurality of cells are mounted one above the other in a stack to define a substantially vertical sheet material path through the apparatus. The use of a vertical orientation for the apparatus leads to a number of advantages. In particular the apparatus occupies only a fraction of the floor space which is occupied by a conventional horizontal arrangement. Furthermore, the sheet transport path in a vertically oriented apparatus may be substantially straight, in contrast to the circuitous feed path which is usual in a horizontally oriented apparatus. The straight path is independent of the stiffness of the sheet material and reduces the risk of scratching compared with a horizontally oriented apparatus. However, the present invention is equally applicable to an apparatus of horizontal configuration, especially such an apparatus in which the sheet material path is substantially straight and each liquid-containing cell of the apparatus includes means for establishing a static liquid level above the plane of the roller nips.

Each cell of the apparatus according to the invention may be of modular construction and be provided with means to enable the cell to be mounted directly above or below an identical or similar other cell. Alternatively, the apparatus may take an integral form or semi-integral form. By the term "semi-integral form" we intend to include an apparatus which is divided by a substantially vertical plane passing through all the cells in the apparatus, particularly the plane of the sheet material path, enabling the apparatus to be opened-up for servicing purposes, in particular to enable easy access to the path-defining rollers.

DETAILED DESCRIPTION OF THE INVENTION

The invention will be described by the following illustrative embodiments with reference to the accompanying drawings without the intention to limit the invention thereto, and in which.

Although only one specific embodiment of a treatment cell according to the invention is shown in the Figures, the invention is not restricted thereto. The apparatus for the wet processing of photographic sheet material such as X-ray film as shown in the Figures comprises a plurality of treatment cells mounted one above another. These cells may be arranged to provide a sequence of steps in the processing of sheet photographic material, such as developing, fixing and rinsing. The cells may be of a modular structure as shown or may be part of an integral apparatus.

Figure 1:
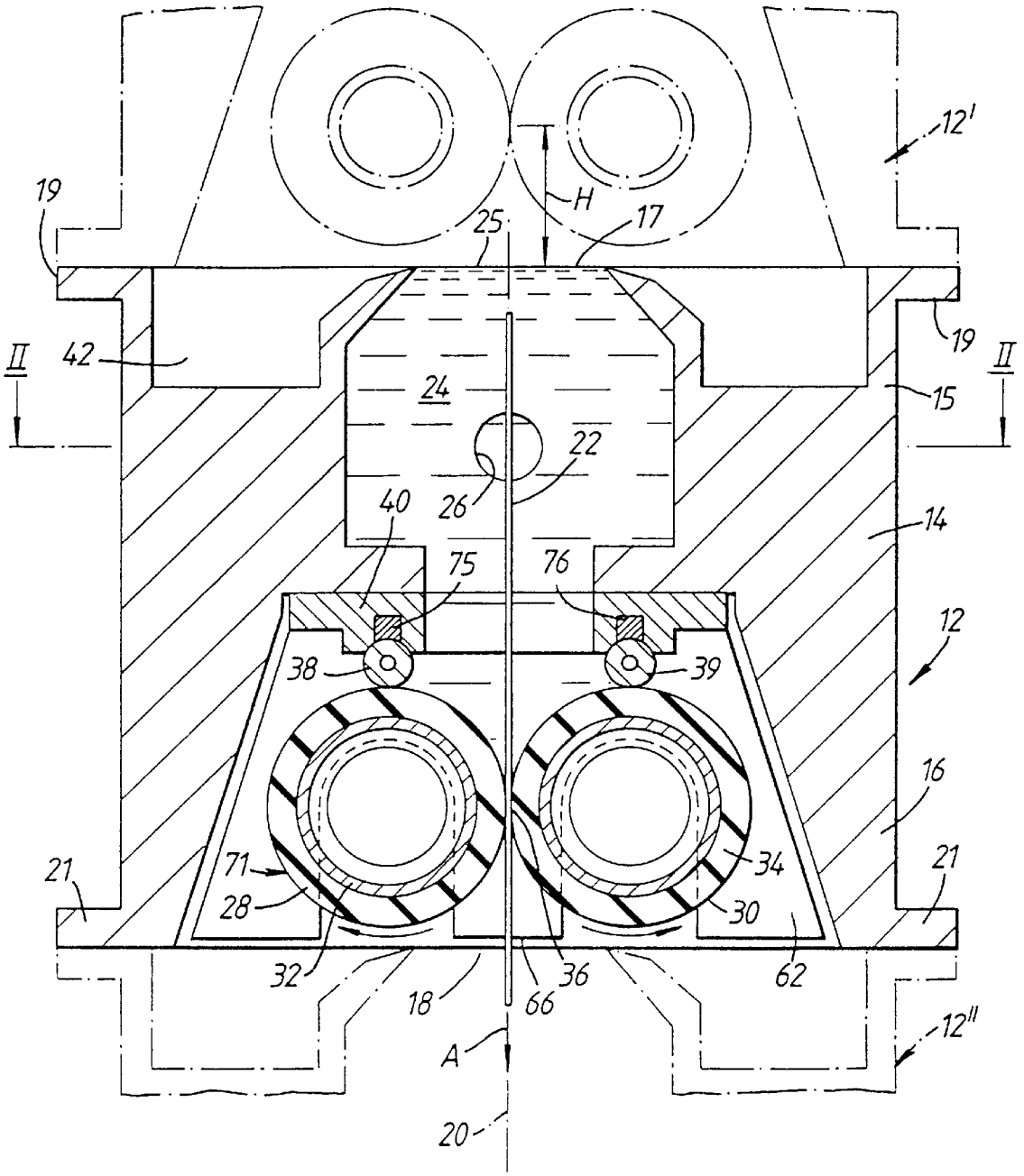
FIG. 1 is, in solid lines, a cross-sectional view of one cell of a vertical processing apparatus according to the invention, with adjacent cells being partly shown in broken lines.
Figure 2:
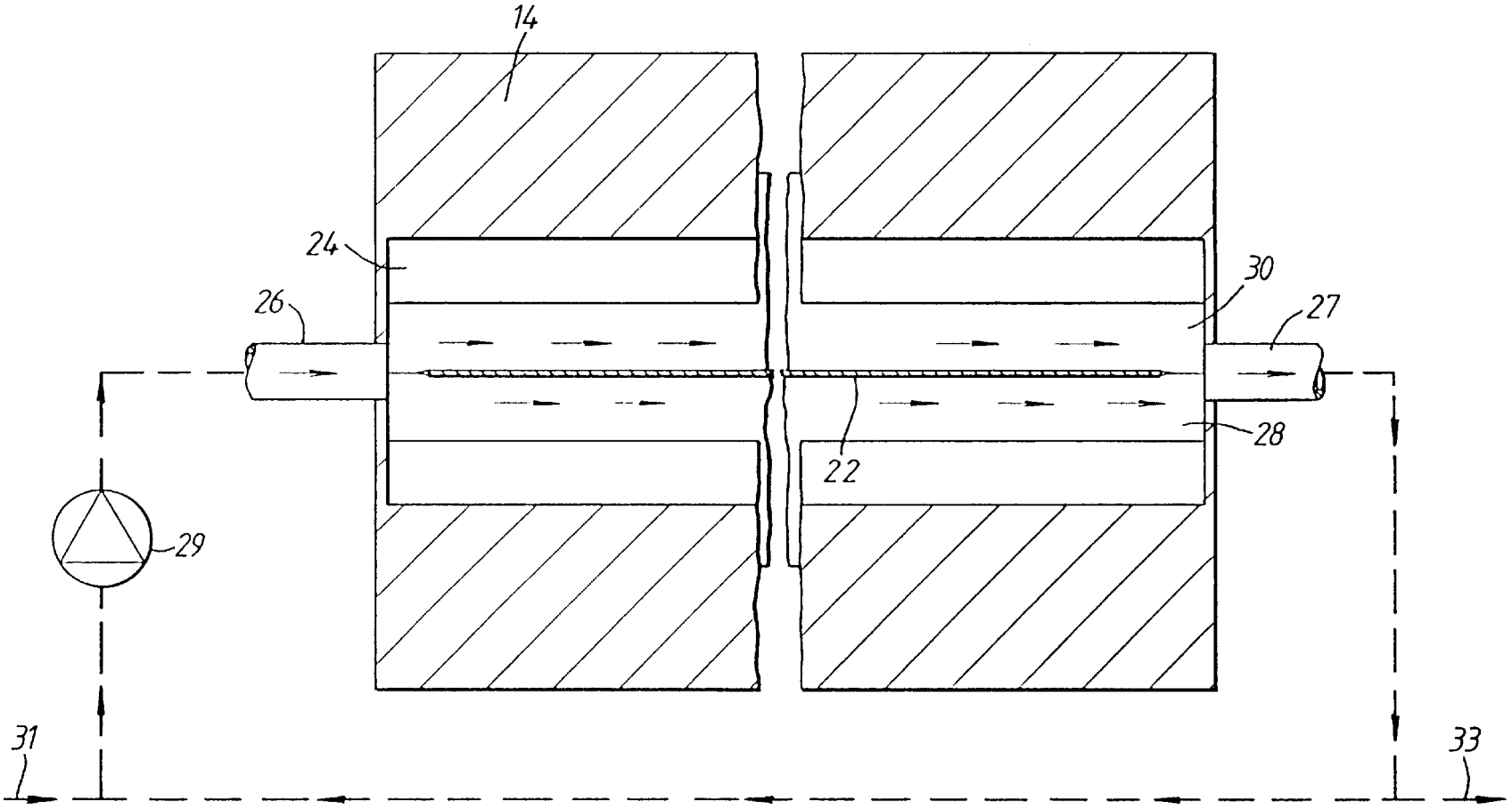
FIG. 2 is a lateral cross-section of one cell of the apparatus, taken on the line II—II in FIG. 1.

As shown in FIG. 1, each cell 12 comprises a housing 14 which is of generally rectangular cross-section and is so shaped as to provide an upper part 15 having an upper opening 17 and a lower part 16 having a lower opening 18. The upper opening 17 constitutes a sheet material inlet and the lower opening 18 constitutes a sheet material outlet. The inlet and outlet define there-between a substantially vertical sheet material path 20 through the cell 12, the sheet material 22 moving in a downwards direction as indicated by the arrow A. Each cell 12 may contain treatment liquid 24, a passage 26 in one end wall of the housing 14 being provided as an inlet for the treatment liquid 24, and a passage 27 in the opposite end wall of the housing 14 constituting an outlet. As can be seen in FIG. 2, the inlet 26 and the outlet 27 form part of a liquid circulation loop which includes a pump 29, a fresh treatment liquid inlet 31 and a waste treatment liquid outlet 33. In an alternative construction to that shown in FIG. 2, the inlet passage 26 and the outlet passage 27 are provided in the same end wall, the vessel includes guide plates positioned parallel to the plane of the sheet material path 20 and on both sides thereof, and guide surfaces, to direct processing liquid from the inlet passage in one direction across the surface of the sheet material 22 to return in the opposite direction to the outlet passage, the pump 29 being provided in the outlet passage 27 rather than in the inlet passage 26. We have found that this construction leads to a more even flow of processing liquid across the surface of the sheet material.

The lower opening 18 is closed by a pair of rotatable path-defining rollers 28, 30 carried in the apparatus. Each path-defining roller 28, 30 is of the squeegee type comprising a stainless steel hollow core 32 carrying an elastomeric covering 34. The core 32 is in cylindrical form having constant internal and external diameters along the length thereof. The path-defining rollers 28, 30 are of identical length biased towards each other with a force sufficient to effect a liquid tight seal but without causing damage to the photographic sheet material 22 as it passes there-between. The line of contact between the path-defining rollers 28, 30 defines a nip 36. The nip 36 has a length which extends beyond the limits of the lower opening 18. The sheet material preferably has a width which is at least 10 mm smaller than the length of the nip 36, so as to enable a spacing of at least 5 mm between the edges of the sheet and the adjacent limit of the nip, thereby to minimise leakage. The path-defining rollers 28, 30 are coupled to drive means (not shown) so as to constitute drive rollers for driving the sheet material 22 along the sheet material path 20.

Figure 5:
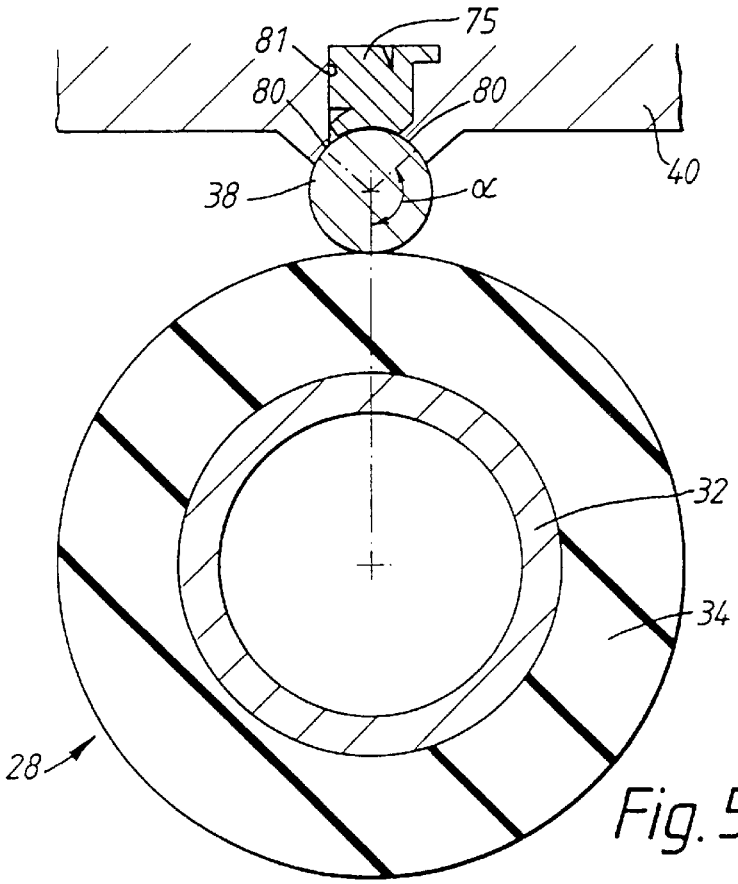
FIG. 5 is an enlarged cross-sectional view taken on the line V—V in FIG. 3.

Each path-defining roller 28, 30 is in sealing contact along its length, with a respective rotatable sealing roller 38, 39 formed for example of hardened or PTFE-coated metal carried by a longitudinal bearing 40, formed, for example, of high density polyethylene. As can be seen in FIG. 5, the longitudinal bearing 40 is in face-to-face contact with the sealing roller over two contact regions 80, which are positioned one on either side of a groove 81 extending along the length of the longitudinal bearing 40, the contact regions 80 being located at an angle $\alpha$ of ±135° relative to the line joining the centres of a path-defining roller 28 and the sealing roller 38. The longitudinal bearing 40 is secured to the housing 14 of the cell 12, the treatment liquid 24 being retained in the cell 12 by the path-defining rollers 28, 30 and the sealing rollers 38, 39. The sealing roller 38 contacts the surface 71 of the first path-defining roller 28 at a location which, in this particular embodiment, is about 900 from the centre of the nip 36 on the fluid side, that is from the plane joining the axes of rotation of the path-defining rollers 28, 30. The benefit of this arrangement is that the sealing force on the path-defining roller does not influence the bias forces between the rollers, or only influence these forces to a limited extent.

Where the apparatus is designed to operate in the opposite direction, the active forces on the path-defining roller versus the nip may be modified to take account, in particular, of the consequential differences in the reaction forces of the sealing roller on the path-defining roller in such a way that the forces on the sheet material are kept constant.

The upper and lower housing parts 15, 16 are provided with flanges 19, 21 respectively to enable the cell 12 to be mounted directly above or below an identical or similar other cell 12', 12", as partly indicated in broken lines in FIG. 1. The upper housing part 15 is so shaped in relation to the lower housing part 16 as to provide a substantially closed connection between adjacent cells. Thus, treatment liquid from cell 12 is prevented from falling into the lower cell 12" by the path-defining rollers 28, 30 and sealing rollers 38, 39, while vapours from the lower cell 12" are prevented from entering the cell 12 or escaping into the environment. This construction has the advantage that the treatment liquid in one cell 12 is not contaminated by contents of the adjacent cells and that by virtue of the treatment liquids being in a closed system evaporation, oxidation and carbonisation thereof is significantly reduced.

The upper part 15 of the housing 14 is so shaped as to define a leakage tray 42. Any treatment liquid which may pass through the roller nip of the next higher cell 12', in particular as the sheet material 22 passes therethrough, drips from the path-defining rollers of that cell and falls into the leakage tray 42 from where it may be recovered and recirculated as desired. The distance H between the surface 25 of the liquid 24 and the nip of the path-defining rollers of the next upper cell 12' is as low as possible.

Figure 3:
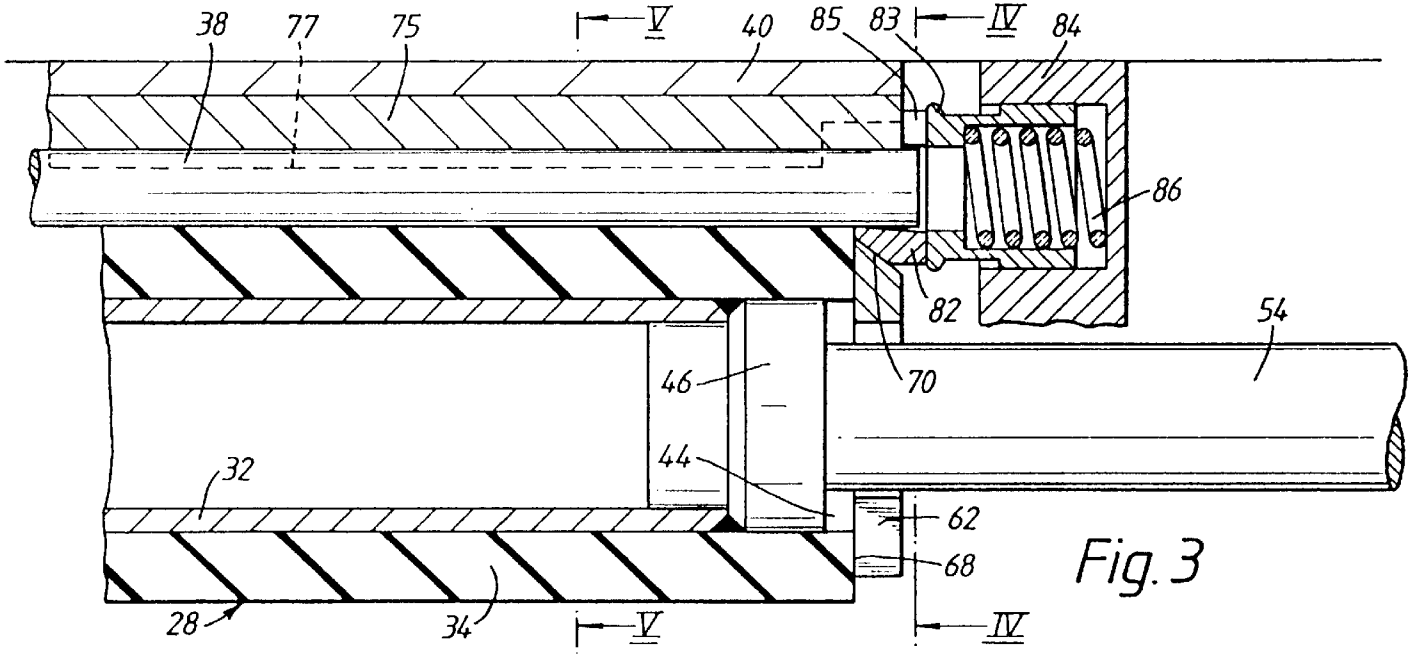
FIG. 3 is a longitudinal cross-sectional partial view showing the detail of the construction of one path-defining roller together with its associated sealing roller and fixed sealing member used in the cell shown in FIG. 1, the view being taken on the line III—III in FIG. 4.
Figure 4:
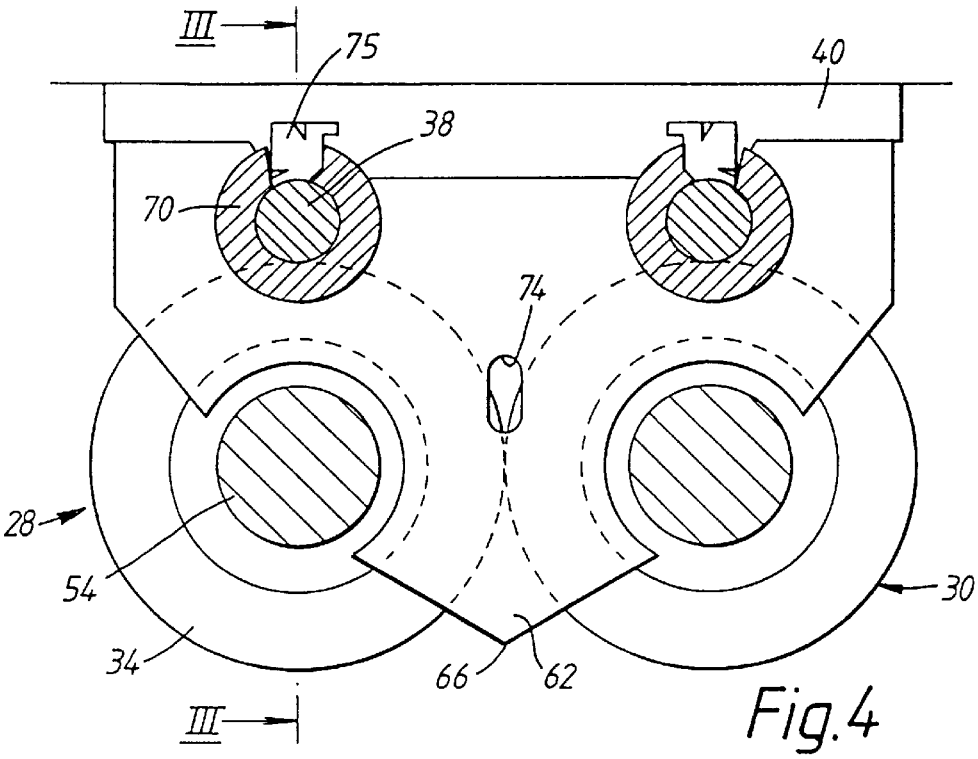
FIG. 4 is a cross-sectional view taken on the line IV—IV in FIG. 3.

The construction of path-defining roller 28 is shown in more detail in FIGS. 3, 4 and 5. The construction of path-defining roller 30 is similar. The roller 28 comprises a hollow core 32 of stainless steel, having a constant outside diameter of 25 mm and an internal diameter of 19 mm. The stainless steel core 32 has a flexural E-modulus of 210 GPa. The core 32 is provided with a covering 34 of EPDM rubber, an elastomer having a hardness of 30 Shore (A). The elastomeric covering 34 has a thickness varying from 7 mm and the roller ends to 7.5 mm at the roller centre. The path-defining roller 28 has a length of 750 mm and a maximum diameter of 40 mm. The maximum $\phi/L$ ratio is therefore approximately 0.053. The core 32 is welded to the boss 46 of a roller shaft 54 which extends axially out of the roller, the free end of the roller shaft 54 being retained in a bearing (not shown) or coupled to a drive wheel (not shown) to provide drive to the roller.

The path-defining roller 28 is in contact with the sealing roller 38 along the length thereof. Each end of the sealing roller 38 extends into an aperture 70 formed in an end plate 62 carried on the housing 14 of the apparatus. The aperture 70 is open-sided towards the top as viewed in the Figures. A sintered PTFE sealing ring 82 surrounds the end of the sealing roller 38 in the aperture 70 and is urged into the aperture and into sealing engagement with the sealing roller 38 by a metal plunger 83 loaded by a spring 86 carried in a body 84, fixed to the housing 14 of the apparatus. As shown in FIG. 3 the sealing ring 82 has a frusto-conically shaped inner surface, thereby establishing a line contact rather than a surface contact with the outer surface of the sealing roller 38. The aperture 70 in the end plate is provided with a matching frusto-conical inner surface.

Compensation for the wear of the sealing ring 82 is achieved by the provision of the spring force which acts in a direction to feed sealing material towards the wear surface.

The upper surface of the sealing roller 38 is in contact with a fixed sealing member 75 in strip form, which is a pressure fit in the groove 81 of the longitudinal bearing 40 or alternatively is secured therein by means of a water- and chemical-proof adhesive, and extends lengthwise beyond the ends of the sealing roller 38.

The sealing roller 38 and the fixed sealing member 75 extend beyond the end face 68 of the covering 34 of the path-defining roller 28. In this way the sealing function is less dependant on tolerances and differential thermal expansion of these components and their thermal expansion relative to the path-defining roller, more precisely between the end faces of the path-defining roller. Further, the contact surfaces of the longitudinal bearing 40 with the sealing roller 38, the lower edge of which is indicated by the broken line 77, are shorter than the path-defining roller 28.

The sealing member 75 is, for example, an extruded profile of Santoprene, an extrusion of various different grades of Santoprene or an extrusion of Santoprene with polypropylene. In all these cases, the Santoprene may be foamed or unfoamed. The Santoprene may be replaced by EPDM. The polypropylene may be replaced by polybutylterephthalate (PBT). A sealing member which is a co-extrusion of EPDM with PBT is also possible. Fillers may be included in the sealing material. The sealing member should have good chemical resistance and durability. The end of the sealing member 75 extends into a slot 85 formed in the PTFE sealing ring 82.

In an alternative embodiment, the sealing member 75 is co-extruded with the longitudinal bearing 40, especially if formed of polyethylene or polypropylene. As can be seen in FIG. 1, a similar sealing member 76 is in contact with the second sealing roller 39.

The end face 68 of the covering 34 is in contact with the end plate 62. The covering 34 extends beyond the end of the core 32 to define a space 44 into which the elastomeric material of the covering 34 may be deformed as a result of a sealing force between the covering 34 and the sealing roller 38 on the one hand and the end plate 62 on the other.

The rollers 28, 30 are positioned relative to each other such that end face 68 of the first roller 28 lies in the same plane as end face of the other roller 30. Each roller is in sealing contact, not only along its length with the respective sealing roller 38, 39 but also by its end faces with the end plate 62. The end plate 62 is so shaped as to have a lower edge 66 which follows a circumferential line around the shaft 54 of the first path-defining roller 28 and a circumferential line around the shaft of the second path-defining roller 30 to enable the end plate to be in face-to-face contact with the end face 68 of the first path-defining roller 28. At its lowest point, the edge 66 is below the level of the nip 36. The circumferential distance over which the end plate 62 is in contact with the end face 68 of the first path-defining roller 28 and the end face of the second roller 30 is as low as possible, but is larger than the circumferential distance between the nip 36 and the sealing roller 38.

The end plates 62 are urged against the end faces of the rollers 28, 30 by springs (not shown). A suitable spring force is from 2 to 500 g/cm of contact between the end plate 62 and the end face 68 of the roller 28 measured at the surface of the roller. The pressure between the end face 68 of the path-defining roller 28 and the end plate 62 is at least $2\rho*g*h$, which in the case where the height of the treatment liquid above the sealing point is 0.4 m means a pressure of at least 9408 Pa. When the path defining roller has a diameter ($\phi$) of 40 mm and the width of contact between the end plate and the end face of the roller is 2 mm over an angle of 90°, a force applied to the end plate of $$\pi\phi/4*0.02*9408=5.64N \ (\equiv 45 \text{ g/cm})$$

is required to establish this pressure.

The second sealing roller 39 is similarly constructed and retained in the longitudinal bearing 40. The two sealing rollers 38, 39 and the two end plates thereby complete a continuous sealing path which, together with the roller nip 36 retains the treatment liquid 24 in the cell 12.

Figure 6:
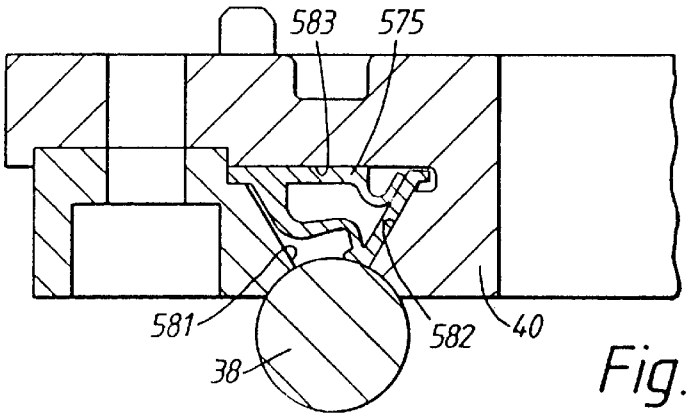
FIG. 6 is a view similar to part of FIG. 5 showing an alternative construction for the fixed sealing member.

In the alternative embodiment shown in FIG. 6, the upper surface of the sealing roller 38 is in contact with a fixed sealing member 575 in strip form, which is a pressure fit in the groove 581 of the longitudinal bearing 40 or alternatively is secured therein by means of a water- and chemical-proof adhesive, and extends lengthwise beyond the ends of the sealing roller 38. The fixed sealing member is formed, for example, of EPDM and is so shaped as to provide pressurised face-to-face contact with that side face 582 of the groove 581 which lies on the fluid side and pressurised face-to-face contact with the upper face 583 of the groove 581. Those surfaces of the fixed sealing member 575 which provide this face-to-face contact are formed of PBT co-extruded with the EPDM.

EXAMPLE

The apparatus described above and shown in the drawings was operated under the following conditions. The cross-sectional area of the developing cell is 16 $cm^2$, with a sheet material path of 11 cm and an average cell width of 75 cm. Developer liquid at a temperature between 35° C. and 40° C. is fed to the cell at a rate of 12 l/min, equivalent to a liquid flow rate between the inlet 26 and the outlet 27 of about 12.5 cm/sec. Photographic sheet material is fed through the cell at a speed of 3.3 cm/sec. The resultant speed of liquid flow over the surface of the sheet material is therefore about 12.9 cm/sec.

We claim:

1. A method of processing photographic sheet material comprising passing said sheet material along a sheet material path (20) through a processing apparatus comprising a plurality of processing cells (12, 12', 12"), and causing processing liquid to pass across the surface of said sheet in at least one of said cells, characterised in that said cell is a closed cell and in that the speed of liquid flow across said sheet material, as measured in a direction perpendicular to the direction of said sheet material path (20), is at least 3 times the speed of said sheet material along said sheet material path (20) and the resultant liquid flow speed is at least 100 mm/sec.

2. A method according to claim 1, wherein the resultant speed of liquid flow across said sheet material is not more than 200 mm/sec.

3. A method according to claim 1, wherein said processing liquid is a photographic sheet material developing liquid.

4. A method according to claim 1, wherein said cell is closed from the next adjacent cell by a rotatable roller (28) biased towards a reaction surface (31) to define a roller nip (36) there-between through which said sheet material path (20) extends and associated sealing means (38, 39) serving to provide a gas- and liquid-tight seal between said roller and reaction surface on the one hand and a cell wall (14) on the other.

5. A method according to claim 1 wherein said processing liquid is fed to said cell adjacent one edge of said sheet material and is withdrawn from said cell adjacent the opposite edge thereof, thereby to provide a continuous liquid flow across said sheet material.

6. A method according to claim 5, wherein said continuous liquid flow extends in a direction perpendicular to the direction of the sheet material path (20).

7. A method according to claim 1 wherein said processing liquid is fed to said cell by a pump, the speed of liquid flow across said sheet material being controlled by operation of said pump.

8. A method according to claim 1, wherein the temperature of said processing liquid in said cell is at least 38° C.

9. A method according to claim 1, wherein said plurality of cells (12, 12', 12") are mounted one above the other in a stack to define a substantially vertical sheet material path (20) through the apparatus.

* * * * *

UNITED STATES PATENT AND TRADEMARK OFFICE

CERTIFICATE OF CORRECTION

PATENT NO. : 5,861,236
DATED : January 19,1999
INVENTOR(S) : Verlinden et al.

It is certified that error appears in the above-identified patent and that said Letters Patent is hereby corrected as shown below:

Column 13, line 48, "900" should read -- 90° --.

Signed and Sealed this

Sixteenth Day of May, 2000

*Attest:*

Q. TODD DICKINSON

*Attesting Officer*

*Director of Patents and Trademarks*